US009763499B2

(12) United States Patent
Ozawa et al.

(10) Patent No.: US 9,763,499 B2
(45) Date of Patent: Sep. 19, 2017

(54) SLIDER FOR SLIDE FASTENER

(71) Applicant: YKK Corporation, Tokyo (JP)

(72) Inventors: Takanori Ozawa, Toyama (JP); Mingsi Wang, Toyama (JP); Yuki Chayahara, Toyama (JP); Keiichi Keyaki, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/267,218

(22) Filed: Sep. 16, 2016

(65) Prior Publication Data

US 2017/0071294 A1 Mar. 16, 2017

(30) Foreign Application Priority Data

Sep. 16, 2015 (JP) ..... 2015-182533

(51) Int. Cl.
*A44B 19/26* (2006.01)

(52) U.S. Cl.
CPC ..... *A44B 19/262* (2013.01)

(58) Field of Classification Search
CPC ..... A44B 19/262; A44B 19/30; A44B 19/305; A44B 19/306; A44B 19/26
See application file for complete search history.

(56) References Cited

U.S. PATENT DOCUMENTS 3,133,328 A * 5/1964 Huelster ..... A44B 19/306 24/421
2011/0197403 A1* 8/2011 Keyaki ..... A44B 19/306 24/418
2016/0143401 A1* 5/2016 Miyazaki ..... A44B 19/308 24/420

FOREIGN PATENT DOCUMENTS

JP 000407612 10/1950
JP S52-069305 A 11/1950

* cited by examiner

*Primary Examiner* — Robert J Sandy
*Assistant Examiner* — Rowland Do
(74) *Attorney, Agent, or Firm* — Kilpatrick Townsend & Stockton LLP

(57) ABSTRACT

There is provided a slider for a slide fastener. The slider includes a slider body, an elastic body and a pull tab. The pull tab includes a shaft, a pull tab main body and a cam. The cam is configured to elastically deform the elastic body when the pull tab is laid down. The slider body includes an upper blade and a pair of pull tab attaching posts. The upper blade includes a recess portion and a crimping portion. The recess portion includes a pair of lateral recess portions and a center recess portion. The crimping portion protrudes from at least one of the lateral recess portions at a protruding location located at a center side relative to both front and rear ends of the center recess portion.

7 Claims, 10 Drawing Sheets

SLIDER FOR SLIDE FASTENER

The present application claims priority to Japanese Patent Application No. 2015-182533, filed on Sep. 16, 2015 and entitled "Slider for Slide Fastener," the entire contents of which are hereby incorporated by reference.

TECHNICAL FIELD

The present invention relates to a slider for a slide fastener, in which a swingable pull tab is held in a laid-down state on an upper surface of a slider body by an elastic body.

BACKGROUND

As one example of sliders, a slider is known, which has a slider body including an element passage extending therethrough in a front and rear direction, an elastic body attached on an upper surface of the slider body, and a pull tab supported on the slider body to be swingable in a front and rear direction above the elastic body (Patent Documents 1 and 2). On an upper surface of the slider body, a recess portion for the elastic body is provided to extend in the front and rear direction and also to be recessed. Also, a crimping portion for crimping the elastic body in the recess portion is provided in the rear of a rear end of the recess portion on the upper surface of the slider body. The crimping portion is configured to protrude upward and also to be inclined forward, i.e., in a forward-inclined state, so that the crimping portion covers the elastic body from above over a range from a rear end thereof to a location located slightly forward from the rear end. Also, the pull tab has a cam located on an end portion thereof, at which the pull tab is supported on the slider body, and configured to come in contact with the elastic body.

Patent Document 1: Japanese Utility Model Application Publication No. S52-69305

Patent Document 2: Japanese Registered Design Publication No. 407612

According of sliders of Patent Documents 1 and 2, when the pull tab is turned and thus a lengthwise middle portion of the elastic body is pushed down by the cam, the elastic body is elastically deformed and front and rear lengthwise ends thereof is displaced upward. However, because the crimping portion in the forward-inclined state covers the rear end of the elastic body from above, a force of pushing up the crimping portion is acted by the rear end of the elastic body. While the pull tab is turned many times, the crimping portion is pushed up and the forward inclination thereof becomes insufficient. Accordingly, the elastic body is likely to be dropped out of the recess portion.

Also, because the crimping portion is inclined forward, a gap, in an upward and downward direction, between the crimping portion and the elastic body is widened as it goes toward a distal end of the crimping portion. Further, if the elastic body is mass-produced, a dimension of the elastic body is slightly different for each product, and thus a tolerance is defined in order to distinguish between good and bad products. If the elastic body has a lengthwise dimension, which is a maximum dimension within a range of the tolerance, the elastic body is received in the recess portion with ratting in the front and rear direction. As a result, the rear end of the elastic body is located near to the rear end of the recess portion and also is located near to a lower end of the crimping portion inclined forward. On the other hand, if the elastic body has a lengthwise dimension, which is a minimum dimension within a range of the tolerance, the elastic body is received in the recess portion with a gap interposed therebetween in the front and rear direction. Then, in some cases, the rear end of the elastic body is likely to be located at a location slightly separated from the rear end of the recess portion and thus to be located at a location corresponding to a middle portion, in a height direction, of the crimping portion inclined forward. In this case, a gap, in the upward and downward direction, between the rear end of the elastic body and the crimping portion is increased, and thus, from a point of time when the slider is assembled, the elastic body is in a state where the elastic body can be easily dropped out.

Further, the slider of Patent Document 1 has a structure in which the pull tab comes in contact with the crimping portion at a location corresponding to the vicinity of the rear end of the recess portion. At such a contact site, the pull tab is likely to be scratched, thereby causing a bad influence on an exterior appearance of the pull tab. Therefore, it is preferable that the contact site between the pull tab and the crimping portion is located close to the shaft in order to allow a scratch to be as less visible as possible even if the pull tab is scratched.

For this reason, if the pull tab is provided with a recess portion to prevent the pull tab from colliding against the crimping as in the slider of Patent Document 2, a scratch due to contact with the crimping portion is eliminated, but the pull tab is shaped to have such a recess portion, thereby causing a bad influence on an exterior appearance of the pull tab.

SUMMARY

Provided is a slider in which an elastic body is at least difficult to be dropped out.

According to an aspect of the embodiments of the present invention, there is provided a slider for a slide fastener, comprising: a slider body comprising an element passage extending therethrough in a front and rear direction of the slider; an elastic body attached on an upper surface of the slider body and elongated in the front and rear direction; and a pull tab supported on the slider body to be swingable in the front and rear direction above the elastic body, wherein the pull tab comprises a shaft extending in a right and left direction and rotatably supported on the slider body, a pull tab main body extending radially outward from the shaft, and a cam protruding radially outward from the shaft, wherein the cam is configured to elastically deform the elastic body when the pull tab is laid down toward one of front and rear sides of the upper surface of the slider body, wherein the slider body comprises, on an upper portion thereof, an upper blade covering the element passage from above and a pair of pull tab attaching posts protruding from right and left sides of an upper surface of the upper blade, wherein the upper blade comprises a recess portion and a crimping portion for crimping the elastic body, between the pair of pull tab attaching posts on the upper surface thereof, wherein the recess portion comprises a pair of lateral recess portions located on right and left sides thereof, and a center recess portion located between the pair of lateral recess portions and configured to receive the elastic body therein, and wherein the crimping portion is configured to protrude from at least one of the pair of lateral recess portions at a protruding location located at a center side relative to both front and rear ends of the center recess portion.

The location of the crimping portion is preferably set to a location, at which the crimping portion is difficult to come in contact with the elastic body when the elastic body is elastically deformed. In order to do so, the following configuration is employed.

That is, the center recess portion includes a pair of front and rear mount surface portions for mounting front and rear ends of the elastic body thereon, and a bottom surface portion arranged between the pair of mount surface portions and located lower than the mount surface portions, and in addition, the crimping portion is configured to cover the bottom surface portion from above.

Also, a height relationship between upper surfaces of the pair of lateral recess portions and an upper surface of the center recess portions does not matter. However, if the pair of lateral recess portions are located lower than the center recess portion, there is a risk that the elastic body mounted on the center recess portion is offset toward the lateral recess portions. Accordingly, in order to facilitate positioning of the elastic body, the following configuration is preferable.

That is, the pair of lateral recess portions have upper surfaces located higher than an upper surface of the center recess portion.

Further, how the pull tab main body comes in contact with the slide body when the slider body is laid down does not matter, but in order to allow a scratch, which is occurred by contact, to be less visible, the following configuration is preferable.

That is, the upper blade includes a horizontal pedestal portion arranged on the upper surface thereof on one side in the front and rear direction from the recess portion and located higher than an upper surface of the recess portion, and the pull tab main body has a flat surface portion to come in face-contact with the pedestal portion in a laid-down state.

A height of an upper end of the crimping portion does not matter, but if higher than an upper surface of the pedestal portion, there is a risk that only the crimping portion comes in contact with the pull tab main body. For this reason, if trying to avoid such contact, the pull tab main body has to be shaped so that, for example, a portion thereof opposing the crimping portion is recessed, thereby influencing an exterior appearance of the pull tab. In order to prevent this, the following configuration is preferable.

That is, an upper surface of the pedestal portion is formed to be located higher than an upper end of the crimping portion.

Further, how the slider body holds the pull tab when the pull tab is turned toward the other of front and rear sides of the upper surface of the slider body does not matter, but in order to allow a scratch, which is occurred on the pull tab, to be less visible when the pull tab is held by the slider body, the following configuration is preferable.

That is, the upper blade includes a pair of stopper portions arranged on the other of front and rear sides of the upper surface of the slider body and configured to hold the pull tab in an inclined state, and in addition, the pair of stopper portions are formed at locations located at the center side, in the front and rear direction, relative to a distal end of the other of the front and rear sides of the upper surface of the upper blade.

Further, in order to prevent the pair of stopper portions from being easily broken, the following configuration is preferable. That is, the pair of stopper portions are configured to protrude from opposing surfaces, which correspond to the pair of lateral recess portions, of the pull tab attaching posts toward the center recess portion.

According to the slider described above, the crimping portion crimps the elastic body at a location located at the center side in the front and rear direction, as compared with the related art. By doing so, when being elastically deformed, the elastic body is covered with the crimping portion above a portion thereof, which has an upward displacement amount smaller than those of front and rear ends thereof. Accordingly, the crimping portion is difficult to be pushed up by the elastic body, as compared with the related art. Therefore, during use of the slider, the crimping portion is hardly plastically deformed by the elastic body and thus the elastic body is difficult to be dropped out of the center recess portion. Further, because the location of the crimping portion is located at the center side relative to the front and rear ends of the center recess portion, even if the pull tab main body is scratched by contact with the crimping portion, the scratched site is located at the center side relative to the front and rear ends of the center recess portion. In addition, because the crimping portion protrudes the lateral recess portions on the upper surface of the upper blade, an upper end of the crimping portion can be set to be located lower than that in the related art, thereby allowing the pull tab main body to be hardly scratched. Due to these synergy effects, an influence of the crimping portion on an exterior appearance of the pull tab main body can be decreased.

Further, if the slider is configured so that the center recess portion includes a pair of front and rear mount surface portions for mounting front and rear ends of the elastic body and a bottom surface portion arranged between the pair of mount surface portions and also located lower than the mount surface portions, and the crimping portion covers the bottom surface portion from above, the crimping portion is located above a portion of the elastic body, which is displaced downward. Accordingly, the crimping portion is hardly plastically deformed by the elastic body and thus the elastic body is difficult to be dropped out of the center recess portion. Also, because the crimping portion is located at the center side, in the front and rear direction, relative to the mount surface portions, an influence thereof on an exterior appearance of the pull tab can be decreased even if the crimping portion comes in contact with the pull tab.

Further, if the slider is configured so that the pair of lateral recess portions have upper surfaces located higher than an upper surface of the center recess portion, positioning of the elastic body upon assembling can be facilitated.

Further, if the slider is configured so that a pedestal portion located higher than an upper surface of the recess portion is provided on the upper surface of the upper blade and the pull tab main body has a flat surface portion to come in face-contact with the pedestal portion, the pull tab main body is difficult to be scratched, for example, as compared with a slider in which a point contact is occurred, thereby decreasing an influence on an exterior appearance of the pull tab main body.

Further, if the slider is configured so that an upper surface of the pedestal portion is formed to be located higher than an upper end of the crimping portion, the crimping portion is difficult to come in contact with the pull tab main body, for example, as compared with a slider in which an upper surface of the pedestal is located lower than the crimping portion, thereby decreasing an influence on an exterior appearance of the pull tab main body.

Further, if the slider is configured so that the upper blade has the pair of stopper portions, the pair of stopper portions come in contact with the pull tab main body at locations located at the center side, in the front and rear direction, relative to a distal end of the other of front and rear sides of the upper surface of the upper blade, when the pull tab is held in an inclined state toward the other of front and rear sides of the upper surface of the slider body. Accordingly, for example, as compared with a case where the pair of stopper portions come in contact with the pull tab main body at the distal end of the other of front and rear sides of the upper surface of the upper blade main body, a scratch of the pull tab main body, which is occurred by contact therewith, is occurred close to the shaft, thereby decreasing an influence on an exterior appearance of the pull tab main body.

In addition, if the slider is configured so that the pair of stopper portions protrude from opposing surfaces, which correspond to the pair of lateral recess portions, of the pull tab attaching posts toward the center recess portion, the stopper portions are stabilized by the pull tab attaching posts and thus are hardly broken.

DETAILED DESCRIPTION

Figure 1:
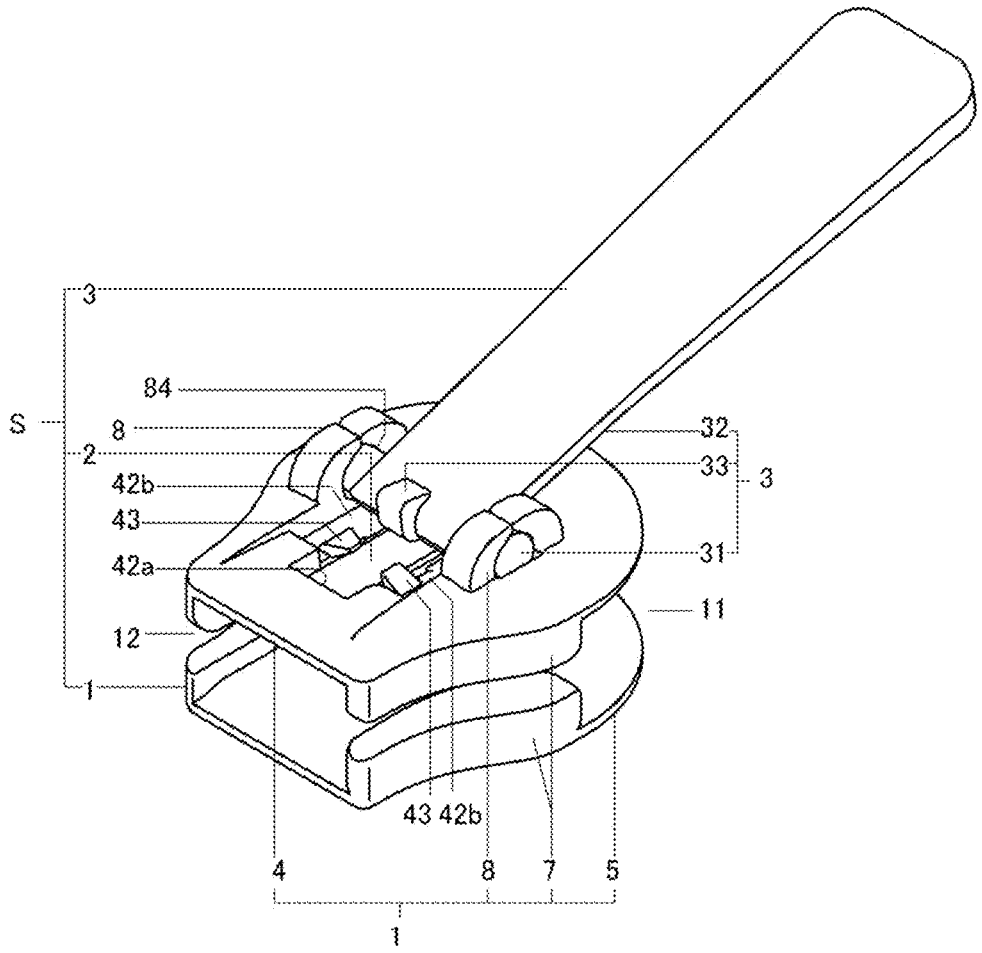
FIG. 1 is a perspective view showing a slider according to a first embodiment of the present invention.
Figure 2:
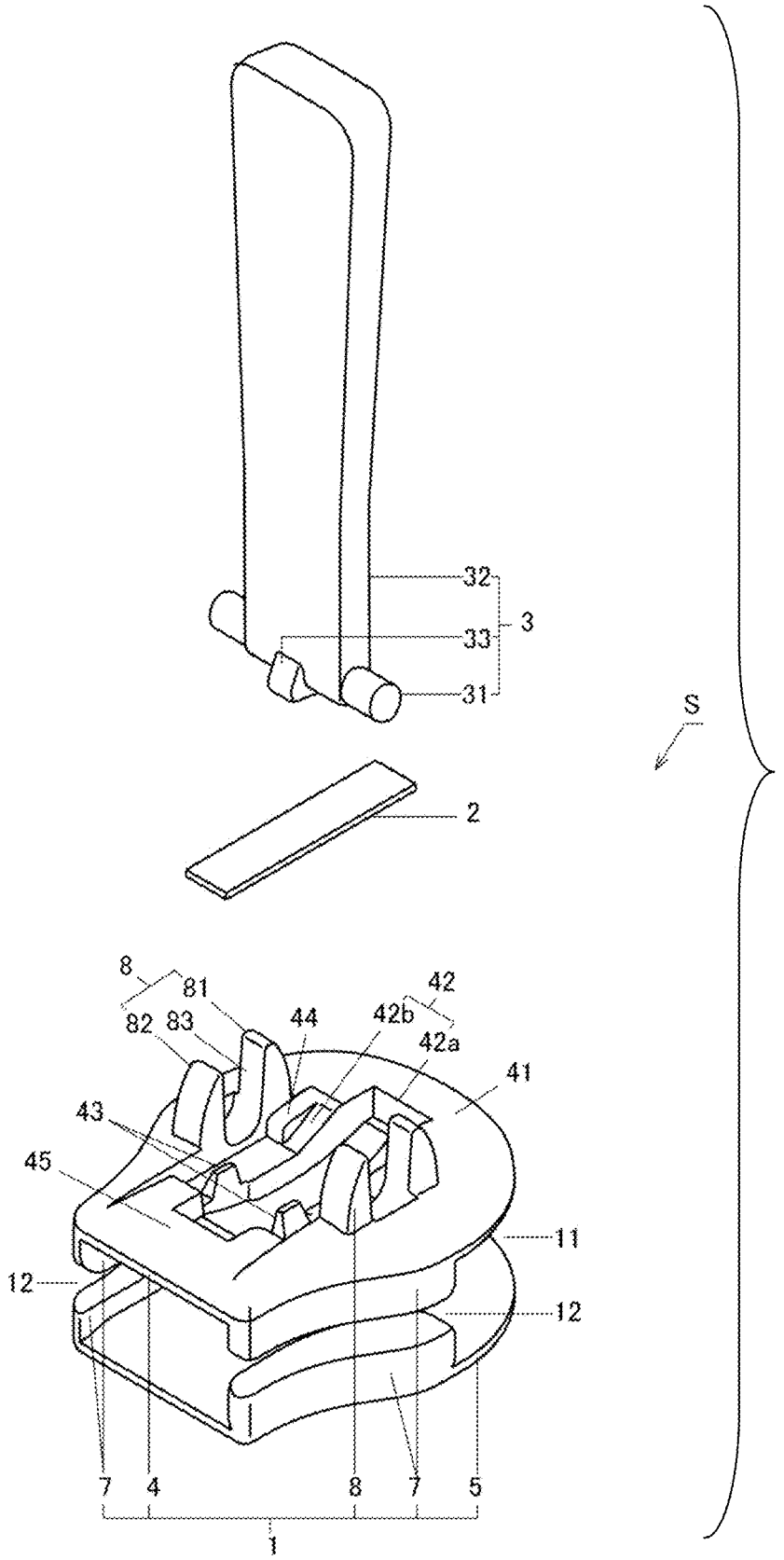
FIG. 2 is a perspective view showing, in an exploded state, the slider according to the first embodiment.

As shown in FIGS. 1 and 2, a slider S for a slide fastener according to a first embodiment of the present invention includes a slider body 1, an elastic body 2 attached on an upper surface of the slider body 1, and a pull tab 3 supported on the slider body 1 to be swingable in a front and rear direction above the elastic body 2. The slider body 1, the elastic body 2 and the pull tab 3 are made of any materials, but of metal as an example.

Figure 5:
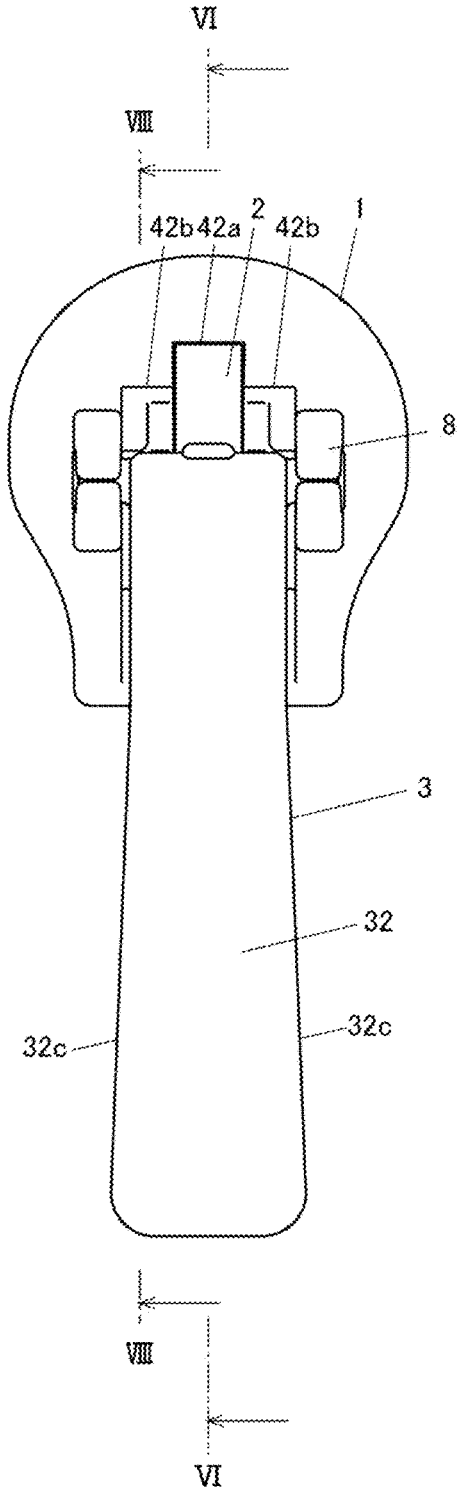
FIG. 5 is a plan view showing the slider according to the first embodiment, in a state where a pull tab is laid down toward a rear side.

Now, directions will be described on the basis of FIG. 5. A front and rear direction refers to a direction, along which the slider body 1 is moved in order to open and close the slide fastener, and corresponds to an upward and downward direction in FIG. 5. An upward direction in FIG. 5 is the forward direction and also a direction along which a pair of element rows of the slide fastener are engaged, and a downward direction in FIG. 5 is the rearward direction and also a direction along which the pair of element rows are disengaged. A right and left direction refers to a right and left direction in FIG. 5. An upward and downward direction refers to a direction perpendicular to a paper surface of FIG. 5, in which the upward direction is a direction toward the front of the paper surface and the downward direction is a direction toward the back of the paper surface.

Figure 6:
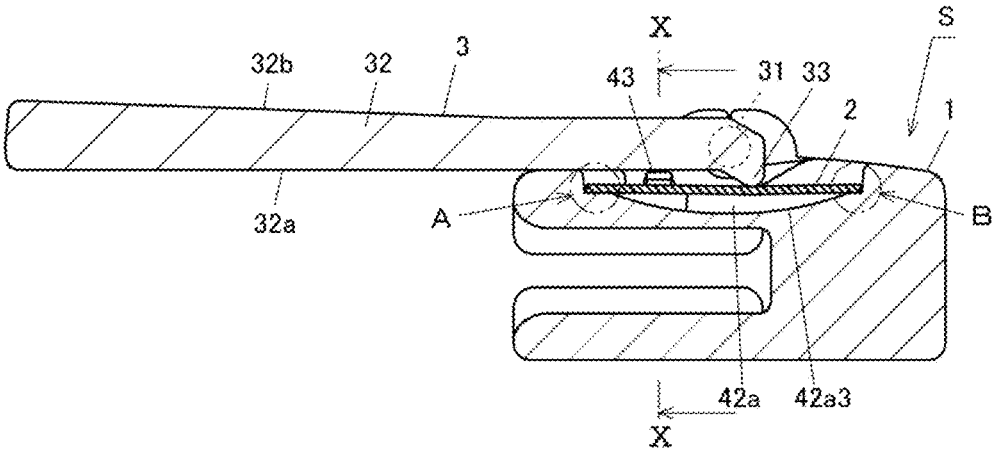
FIG. 6 is a sectional view taken along a line VI-VI in FIG. 5.

As shown FIGS. 2, 5 and 6, the pull tab 3 includes a shaft 31 extending in the right and left direction, a pull tab main body 32 extending radially outward from the shaft 31, and a cam 33 protruding outward from the shaft 31 but in a direction different from the extending direction of the pull tab main body 32.

Figure 10:
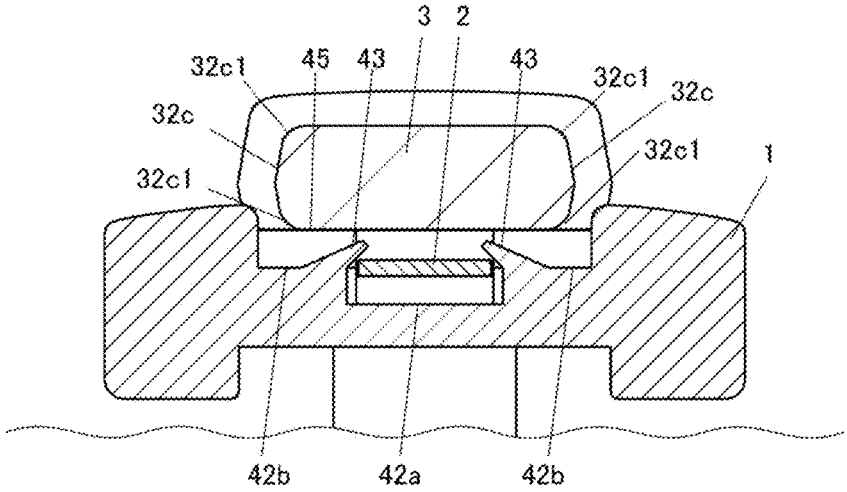
FIG. 10 is a sectional view taken along a line X-X in FIG. 6.
Figure 11:
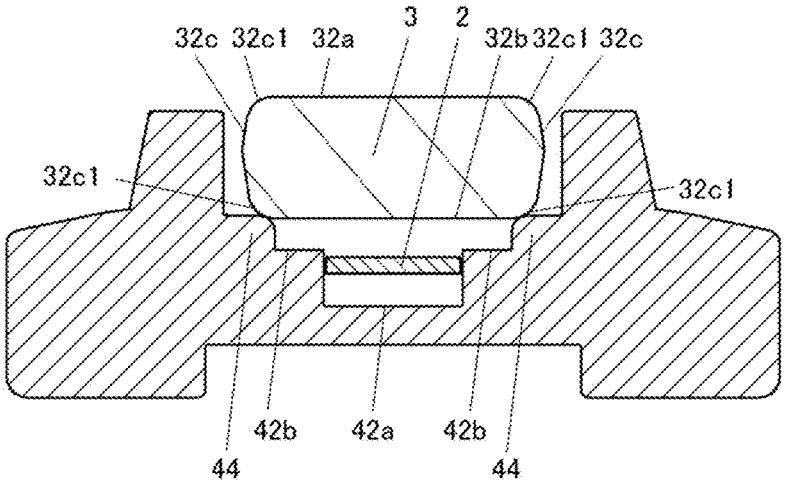
FIG. 11 is an end elevation view showing an end surface of a portion cut along a line XI-XI in FIG. 9.

The pull tab main body 32 is a portion to be picked up with fingers and has the shape of an elongated rectangular plate having long sides and short sides. Also, one surface 32*a* of both surfaces, which are oriented in a plate thickness direction, of the pull tab main body 32, opposes a rear side of the upper surface of the slider body 1 when the pull tab main body 32 is laid down toward the rear side. This opposing one surface 32*a* is a flat surface portion parallel to the right and left direction and becomes a horizontal plane when the pull tab main body 32 is laid down toward the rear side. On the other hand, the other surface 32*b* of both surfaces, which are oriented in the plate thickness direction, of the pull tab main body 32 has an inclined shape with respect to the one surface 32*a*, in such a manner that a thickness is increased as it goes from the shaft 31 toward an end portion thereof. Also, as shown in FIGS. 10 and 11, both surfaces 32*c* and 32*c*, which are oriented toward a short-side direction, of the pull tab main body 32 are right and left side surfaces thereof and are configured so that portions (corner portions) 32*c*1 near to both surfaces 32*a* and 32*b* in the thickness direction become a convexly curved surface having a circular-arc cross section. Further, the right and left side surfaces 32*c* and 32*c* of the pull tab main body 32 have a shape in which middle portions thereof in the thickness direction protrude farthest outward in the right and left direction.

The shaft 31 has a cylindrical shape, in which a lengthwise middle portion thereof is integrated with the pull tab main body 32 and both lengthwise end portions thereof protrude in the right and left direction from both side surfaces of the pull tab main body 32. Both lengthwise end portions are rotatably supported on the slider body 1.

Figure 12:
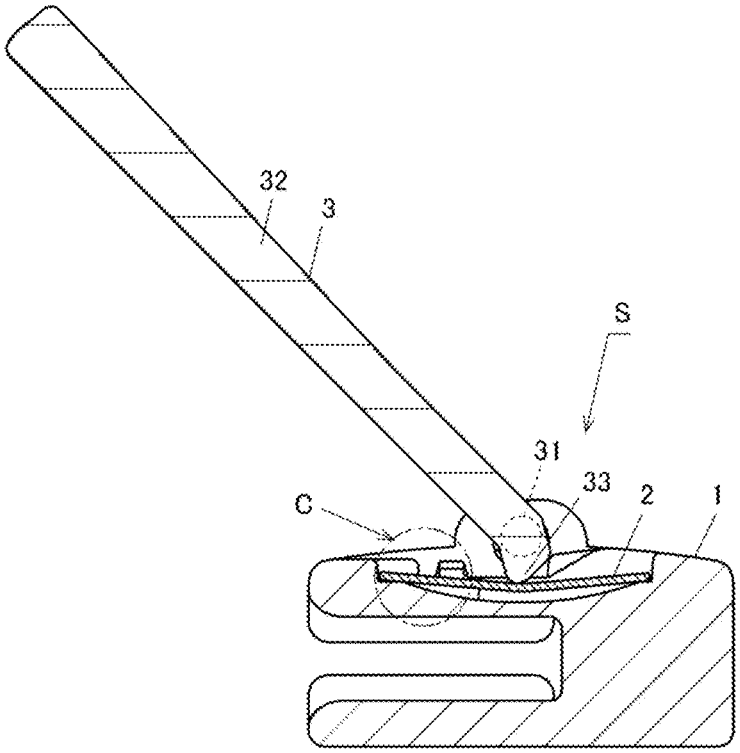
FIG. 12 is a sectional view showing the slider according to the first embodiment, in a state where the pull tab is inclined toward the rearward direction.
Figure 13:
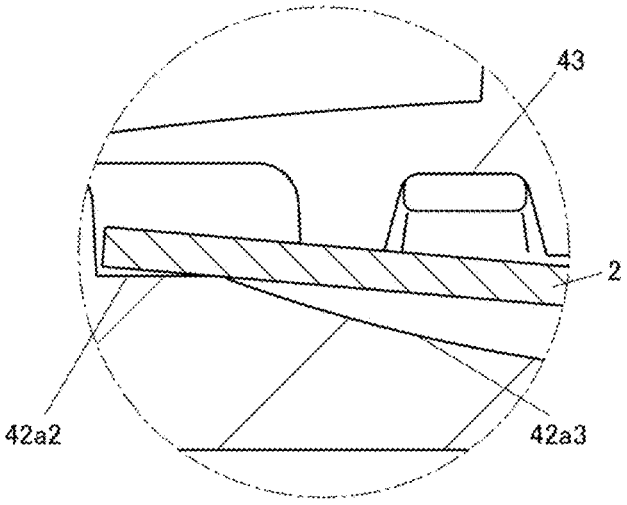
FIG. 13 is an enlarged view of a C section in FIG. 12.

The cam 33 protrudes radially outward from the lengthwise middle portion of the shaft 31 toward the flat surface portion 32*a* of the pull tab main body 32. More specifically, as shown in FIG. 6, when the pull tab main body 32 is laid down toward the rear side of the upper surface of the pull tab body 1, the cam 33 protrudes forward and downward relative to the flat surface portion 32*a* of the pull tab main body 32 and also the center of the shaft 31. A protrusion length of the cam 33 downward relative to the flat surface portion 32*a* is set to a length sufficient to elastically deform the elastic body 2 when the pull tab main body 32 is inclined toward the rearward direction as shown in FIGS. 12 and 13. Thus, by elastically deforming the elastic body 2 using the cam 33, the pull tab main body 32 can be pushed in and laid down toward the rear side.

As shown in FIG. 2, the elastic body 2, which is a leaf spring, is a flat plate having a predetermined thickness and has a rectangular shape in which long sides are sufficiently long relative to short sides. In an example of the figure, the long sides are three or more times longer than the short sides. The leaf spring 2 is fixed on the slider body 1.

As shown in FIGS. 1 to 4, the slider body 1 includes an upper blade 4 and a lower blade 5 opposing each other in the upward and downward direction with a gap interposed therebetween, a connecting post 6 for connecting the upper blade 4 and lower blade 5 at middle portions, in the right and left direction, of front portions thereof, a pair of flanges 7 and 7 protruding upward or downward from right and left end portions of at least one (both in the figures) of the upper blade 4 and the lower blade 5 to narrow the gap, in the upward and downward direction, between the upper blade 4 and the lower blade 5, and a pair of pull tab attaching posts 8 and 8 opposing each other with a gap interposed therebetween in the right and left direction and protruding from a middle portion, in the front and rear direction, of an upper surface of the upper blade 4.

Also, the slider body 1 has as an interior space an element passage 11 for allowing a pair of element rows to pass therethrough at a middle portion thereof in the right and left direction, and also has a pair of tape grooves 12 and 12 for allowing tapes, on which the element rows are respectively attached, to pass therethrough at both end portions thereof in the right and left direction.

The element passage 11 extends through the slider body in the front and rear direction and is configured so that a rear side thereof defines one passage having a wide transverse width and a front side thereof is bifurcated into two right and left passages by a connecting post 6. Also, a portion above the element passage 11 corresponds to an upper portion of the slider body 1.

The tape grooves 12 extend through the slider body 1 in the front and rear direction, and with respect to the right and left direction, are configured so that portions thereof located toward a middle portion, in the right and left direction, of the slider body 1 are communicated with the element passage 11 and portions thereof located toward right and left ends of the slider body 1 are opened to the outside.

The pair of pull tab attaching posts 8 and 8 are configured to oppose each other with a gap interposed therebetween in the right and left direction and are formed on a middle portion, in the front and rear direction, of the upper surface of the upper blade 4. Also, each pull tab attaching post 8 has a front post 81 and a rear post 82 opposing each other with a gap interposed therebetween in the front and rear direction. Before attaching the pull tab 3, an U-shaped shaft inserting groove 83, which is opened upward as viewed in a side view, is formed between the front post 81 and the rear post 82, and a gap between upper end portions of the front post 81 and the rear post 82 in the front and rear direction is set to be wider than a diameter of the shaft 31 of the pull tab 3. Also, after attaching the pull tab 3, the front post 81 and the rear post 82 are plastically deformed in directions approaching each other and thus are in almost contact with each other, the shaft inserting groove 83 becomes a shaft hole 82 having a circle shape as viewed in a side view, and the gap between the upper end portions of the front post 81 and the rear post 82 becomes narrower than the diameter of the shaft 31. Further, lower ends of the pair of shaft inserting grooves 83 and 83, which become a pair of shaft holes 84 and 84, are formed in a stepped shape to be located lower than portions, which are located outward in the right and left direction from the pair of pull tab attaching posts 8 and 8, of an upper surface of an upper blade main body 41. In addition, a dimension, in the right and left direction, of the pair of shaft holes 84 and 84 are set to be slightly longer than a dimension, in the right and left direction, of the shaft 31, so that the shaft 31 and thus the pull tab 3 is rotatably supported in the pair of shaft holes 84 and 84 without rattling in the right and left direction.

The upper blade 4 includes an upper blade main body 41 having a plate shape to cover the element passage 11 from above, a recess portion 42 recessed between the pair of pull tab attaching posts 8 and 8 on an upper surface of the upper blade main body 41, a pair of crimping portions 43 and 43 protruding from right and left sides of an upper surface of the recess portion 42, a pair of stopper portions 44 and 44 protruding from right and left sides of a front portion of the upper surface of the recess portion 42 and defining a front limit of a swing range of the pull tab 3, and a pedestal portion 45 located rearward relative to the recess portion 42 on the upper surface of the upper blade main body 41 and defining a rear limit of the swing range of the pull tab 3.

The recess portion 42 is formed to be recessed relative to the surroundings thereof and also to extend over the entire range, in the right and left direction, between the pair of pull tab attaching posts 8 and 8. Also, the recess portion 42 has a pair of lateral recess portions **42*b* and 42*b* respectively adjacent to the pair of pull tab attaching posts 8 and 8, and a center recess portion 42*a* located between the pair of lateral recess portions 42*b* and 42*b*. The center recess portion 42*a* is preferably located at the center, in the right and left direction, of the upper blade main body 41, but may be sufficient if located between the pair of lateral recess portions 42*b* and 42*b* and also may formed at a location offset in either of the right and left directions from the center, in the right and left direction, of the upper blade main body 41**.

Figure 3:
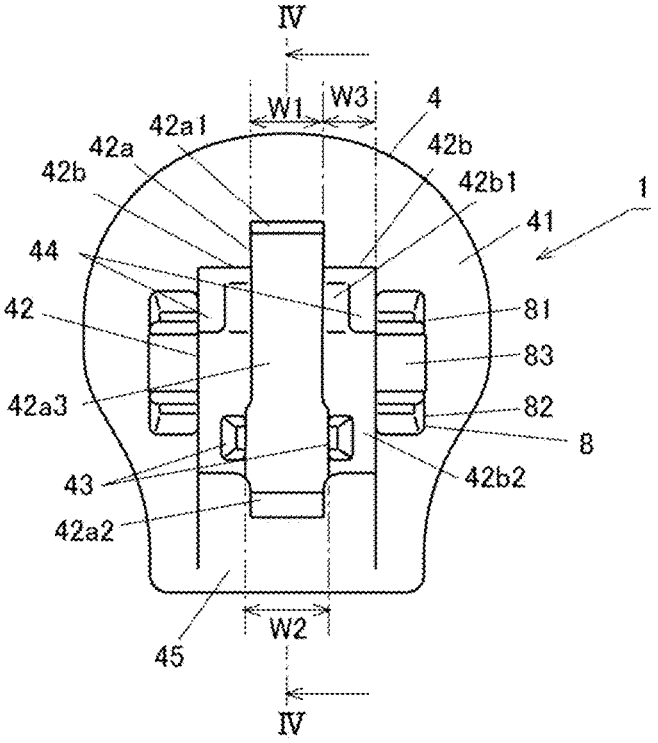
FIG. 3 is a plan view showing a slider body of the slider according to the first embodiment.
Figure 4:
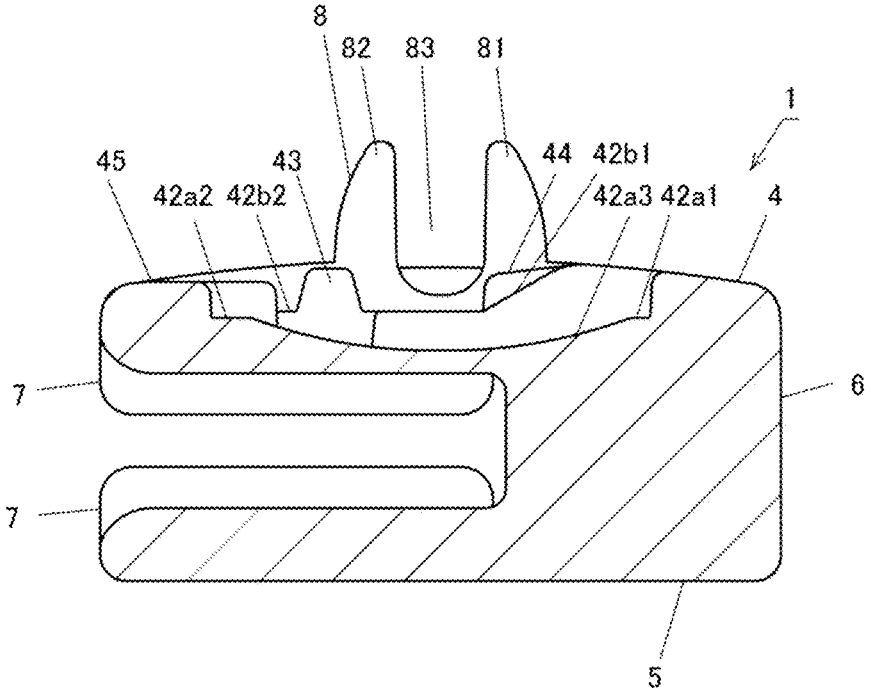
FIG. 4 is a sectional view taken along a line IV-IV in FIG. 3.
Figure 7A:
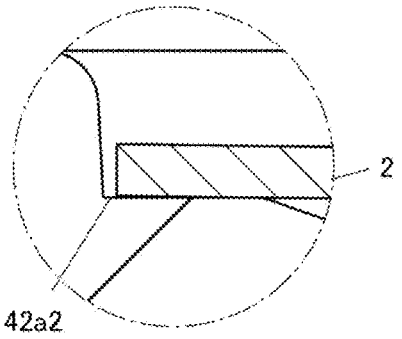
FIGS. 7A and 7B are respectively enlarged views of A and B sections in FIG. 6.
Figure 7B:
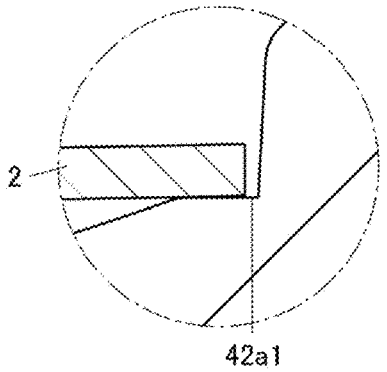
Figure 8:
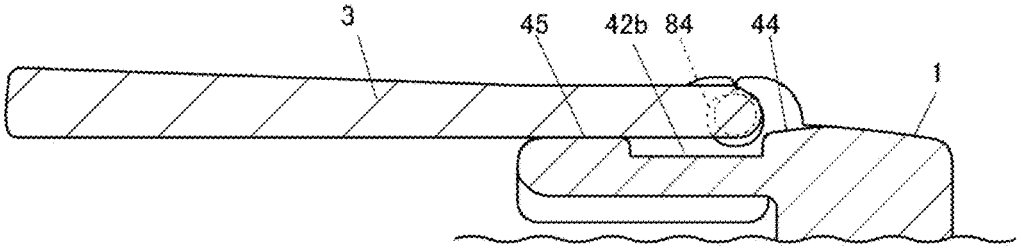
FIG. 8 is a sectional view taken along a line VIII-VIII in FIG. 5.

As viewed in a plan view, the center recess portion **42*a* has the shape of a rectangle extending in the front and rear direction to be perpendicular to a straight line connecting the pair of shaft inserting grooves 83 and 83, and also dimensions thereof in the front and rear direction and the right and left direction are set to be slightly larger than dimensions of the leaf spring 2. Also, front and rear end portions of an upper surface (bottom surface) of the center recess portion 42*a* are formed to have the same height in the upward and downward direction and also to be located higher than a middle portion (portion between the front and rear end portions) of the upper surface. Further, as shown in FIGS. 6, 7A and 7B, the front and rear end portions of the upper surface of the center recess portion 42*a* are mount surface portions 42*a*1 and 42*a*2, on which the leaf spring 2 is to be mounted, and also horizontal planes. The front mount surface portion 42*a*1 has a dimension in the front and rear direction shorter than that of the rear mount surface portion 42*a*2. Further, the middle portion of the center recess portion 42*a*, which is located between a pair of mount surface portions 42*a*1 and 42*a*2, is a bottom surface portion 42*a*3 located lower than the pair of mount surface portions 42*a*1 and 42*a*2 and is formed as a circular-arc curved surface so that a depth thereof is gradually deepened as it goes from the front and rear end portions toward the center thereof. In addition, as shown in FIG. 3, the center recess portion 42*a* is formed in such a wide shape that a transvers width (dimension in the right and left direction) W2 of a rear portion of the bottom surface portion 42*a*3 is wider in the right and left direction than a transvers width W1 of the other portions (in particular, the pair of mount surface portions 42*a*1 and 42*a*2). More specifically, a left side of the bottom surface portion 42*a*3 is configured so that a rear portion thereof is located at the left relative to a front portion thereof, and a right side of the bottom surface portion 42*a*3** is configured so that a rear portion thereof is located at the right relative to a front portion thereof.

As viewed in a side view, each lateral recess portion 42*b* is configured so that a front side thereof forms an inclined surface 42*b*1, which is risen as it goes toward the front, and a rear side thereof forms a horizontal surface 42*b*2. Assuming that a location in the front and rear direction substantially equal to a front end of the shaft hole 84 (shaft inserting groove 83) is a reference location, the inclined surface 42*b*1 is formed in a region forward from the reference location, and the horizontal surface 42*b*2 is similarly formed in a region rearward from the reference location. Also, as viewed in a plan view, the lateral recess portion 42*b* has a rectangular shape and is configured so that a dimension thereof in the front and rear direction is longer than a dimension thereof in the right and left direction, the dimension in the front and rear direction is shorter than a dimension of the center recess portion 42*a*, and also a transvers width W3 thereof, which is the dimension (maximum dimension) in the right and left direction, is narrower than the transverse width W1 of the pair of mount surface portions 42*a*1 and 42*a*2 of the center recess portion 42*a*. Further, with respect to the front and rear direction, a front end of the lateral recess portion 42*b* is located forward relative to a front end of the pull tab attaching post 8 and also located rearward relative to a front end of the center recess portion 42*a*, and a rear end of the lateral recess portion 42*b* is located rearward relative to a rear end of the pull tab attaching post 8 and also located forward relative to a rear end of the center recess portion 42*a*.

Also, because the transverse width W2 of the rear portion of the bottom surface portion 42*a*3 is wider than front and rear sides thereof, a right side of the left lateral recess portion 42*b* at such a wider portion is recessed left, and a left side of the right lateral recess portion 42*b* is recessed right. In addition, one crimping portion 43 protrudes from a portion, which corresponds to an upper surface of each of the lateral recess portions 42*b* and is located laterally from each of such recessed portions. When the leaf spring 2 is crimped by the crimping portions 43, the recessed portions become deformed regions of lower end portions the crimping portions 43.

Each crimping portion 43 is a protrusion tapered toward a distal end thereof, and in a step before the leaf spring 2 is crimped, has the shape of a rectangular column protruding upward, in which as viewed in a plan view, directions of four sides of the rectangle coincide with the front and rear direction and the right and left direction. Also, in a step after the leaf spring 2 is crimped as shown in FIG. 10, the crimping portion 43 protrudes in an inclined state from the upper surface of the lateral recess portion 42*b* toward above the leaf spring 2 and thus covers and presses the leaf spring 2 from above. Meanwhile, the pair of crimping portions 43 and 43 are bilateral symmetrically formed.

As shown in FIGS. 2 to 4 and 11, each stopper portion 44 protrudes upward from a portion on a front side of the upper surface of the upper blade main body 41, which is located at the center side, in the front and rear direction, relative to a distal end thereof, more specifically from a front portion (inclined surface 42*b*1) of the upper surface of the lateral recess portion 42*b*, and also protrudes laterally from a side surface of the front post 81, which faces the lateral recess portion 42*b*. Also, because the pair of stopper portions 44 and 44 are bilateral-symmetrically formed, the pair of stopper portions 44 and 44 are configured to respectively protrude from opposing surfaces of the pair of pull tab attaching posts 8 and 8 toward the center recess portion 42*a*. The pair of stopper portions 44 and 44 opposes with each other in the right and left direction and are configured so that upper end portions of rear portions thereof are in point-contact with right and left side surfaces 32*c* and 32*c* of the pull tab 3, more specifically with corner portions 32*c*1 of right and left side surfaces 32*c* and 32*c* of the pull tab main body 32. Further, when coming in contact with the pair of stopper portions 44 and 44, the pull tab 3 is prevented from swinging forward and thus is spaced away from the upper surface of the upper blade main body 41 in a forward-inclined state. On the other hands, rearward swinging of the pull tab 3 is prevented by the pedestal portion 45.

As shown in FIGS. 2 to 4, 6 and 10, the pedestal portion 45 corresponds to the upper surface of the upper blade main body 41 and is a portion, which is located between the pair of pull tab attaching posts 8 and 8 in the right and left direction and also is located rearward relative to the recess portion 42 in the front and rear direction, more specifically located rearward relative to rear ends of the pair of lateral recess portions 42*b* and a rear end of the center recess portion 42*a*. Also, the pedestal portion 45 forms a horizontal plane and is formed in a U-shape as viewed in a plane view. Further, the pedestal portion 45 is located higher than upper ends of the crimping portions 43 in the step after the leaf spring 2 is crimped, and a part of the flat surface portion 32*a* of the pull tab main body 32 comes in face-contact with the pedestal portion 45. In addition, an upper surface of the pedestal portion 45 is formed to be located higher than the upper surfaces of the lateral recess portions 42*b* (horizontal surfaces 42*b*2 on rear sides of the lateral recess portions 42*b*), on which the crimping portions 43 are respectively formed. Incidentally, the horizontal surfaces 42*b*2 of the lateral recess portion 42*b* are formed to be located higher than the mount surface portions 42*a*1 and 42*a*2 on the upper surface (bottom surface) of the center recess portion 42*a*.

The slider S according to the first embodiment of the present invention as described above is assembled in the following procedures (1) to (3).

(1) The leaf spring 2 is mounted on the center recess portion 42*a* of the upper blade 4. At this time, because upon designing, the upper surfaces of the pair of lateral recess portions 42*b* and 42*b* are set to be located higher than the upper surface of the center recess portion 42*a* and both front and rear ends of the pair of lateral recess portions 42*b* and 42*b* are set to be located at the center side relative to both front and rear ends of the center recess portion 42*a*, front and rear end portions of the leaf spring 2 are hardly offset in the right and left direction, thereby facilitating positioning of the leaf spring 2.

(2) The pair of crimping portions 43 and 43 are pushed and plastically deformed to be inclined toward the center in the right and left direction, thereby crimping the leaf spring 2 by the pair of crimping portions 43 and 43 and thus preventing the leaf spring 2 from being dropped out of such a center receiving portion. At this time, upper ends of the crimping portions is set to have a height equal to or lower than the upper surface of the pedestal portion 45. Incidentally, in an example of FIG. 10, the height is set to be lower.

(3) Both ends of the shaft 31 of the pull tab 3 are mounted on the shaft inserting groove 83 and 83 of the pair of pull tab attaching posts 8 and 8, and then upper end portions of the front posts 81 and the rear posts 82 are plastically deformed so that gaps therebetween in the front and rear direction are narrowed.

The slider S assembled in this way has the following effects. As shown in FIGS. 6 and 10, when the pull tab 3 is laid down rearward, the cam 33 of the pull tab 3 contacts or approaches the middle portion, in the front and rear direction, of the leaf spring 2 from above. Whether the cam 33 contacts or approaches the middle portion is depended on dimension precision of components of the slider S. Also, there are two types of contact. A first contact type is a case where the cam 33 elastically deforms the leaf spring 2 in a thickness direction thereof. A second contact type is a case where the cam 33 is simply abutted against the leaf spring without elastically deforming at all the leaf spring in the thickness direction. In the case of the first contact type, the cam 33 and thus the pull tab 3 is pushed up by a restoring force of the leaf spring 2, so that the pedestal portion 45 comes in face-contact with a part of the flat surface portion 32*a* of the pull tab main body 32. In the case of the second contact type and approach type, the restoring force of the leaf spring 2 is not obtained, but the pedestal portion 45 comes in face-contact with a part of the flat surface portion 32*a* of the pull tab main body 32. In either case of the contact type and approach type, a portion of the flat surface portion 32*a* to come in face-contact with the pedestal portion 45 is scratched whenever coming in contact therewith, but due to the face contact, the scratch is less visible and thus an influence thereof on an exterior appearance of the pull tab 3 can be decreased. Also, when the pull tab 3 is laid down rearward, the pull tab main body 31 is spaced away from the crimping portions 43 because the upper ends of the crimping portions 43 are located lower than the upper surface of the pedestal portion 45.

Further, when in order to disengage element rows of the slide fastener, the slider S is used in a state where the pull tab 3 is slightly turned upward and thus inclined rearward, as shown in FIG. 12, the leaf spring 2 is pressed and elastically deformed by the cam 33. When being elastically deformed, a portion of the leaf spring 2 which is to be covered with the pair of crimping portions 43 and 43 is a portion (portion located toward the shaft 31) of the leaf spring 2 which is located at the center side relative to front and rear ends thereof. If being elastically deformed, the leaf spring 2 is configured so that the front end portion thereof is displaced upward relative to a rear end of the front mount surface portion 42*a*1 as a fulcrum and the rear end portion is displaced upward relative to a front end of the rear mount surface portion 42*a*2 as a fulcrum. Also, if being elastically deformed, the leaf spring 2 is configured so that a portion thereof pressed by the cam 33 is displaced downward. Further, a portion of the leaf spring 2, which is located below the pair of crimping portions 43 and 43, is located at the center side in the front and rear direction relative to the front and rear ends of the leaf spring 2 and thus has an upward displacement amount smaller than those of the front and rear ends of the leaf spring 2 when the leaf spring 2 is elastically deformed. Accordingly, the crimping portions 43 are difficult to be pushed up by the leaf spring 2 as compared with the related art. Also, in the example as shown, the portion of the leaf spring 2, which is located below the pair of crimping portions 43 and 43, is located between the rear end of the front mount surface portion 42*a*1 and the front end of the rear mount surface portion 42*a*2 and thus is displaced downward when the leaf spring 2 is elastically deformed. Accordingly, the crimping portions 43 are not pushed up by the leaf spring 2. Therefore, even if the slider S is used, the crimping portions 43 are hardly plastically deformed by the leaf spring 2 and thus the leaf spring 2 is difficult to be dropped out of the center recess portion 42*a*. In other words, because the front and rear end portions of the leaf spring 2 are mounted on the pair of mount surface portions 42*a*1 and 42*a*2 and also the pair of crimping portions 43 and 43 cover the bottom surface portion 42*a*3 from above, the pair of crimping portions 43 and 43 are located above the portion of the leaf spring 2, which is displaced downward. As a result, the crimping portions 43 are hardly plastically deformed by the leaf spring 2 and thus the leaf spring 2 is difficult to be dropped out of the center recess portion 42*a*.

In addition, the pair of crimping portions 43 and 43 do not come in contact with the pull tab main body 32 because upper ends thereof are located lower than the pedestal portion 45, and thus have no risk of scratching the pull tab 3 by use. But, even if the upper ends come in contact with the pull tab main body 32, the contact location is close to the shaft 31 and thus a scratch is less visible.

Further, when the crimping portions 43 is crimped and thus plastically deformed, lower end portions thereof go into the center recess portion 42*a*, but because the rear portion of the center recess portion 42*a* has a wide shape, the crimping portions 43 do not come in contact with side surfaces of the leaf spring 2. Thus, the leaf spring 2 is not pressed in the right and left direction by the pair of crimping portions 43 and 43, so that elastic deformation of the leaf spring 2 is not hindered by the pair of crimping portions 43 and 43. On the other hand, even if the pair of crimping portions 43 and 43 are in contact with the leaf spring 2, an influence on the elastic deformation is insignificant because a space is left below a contact portion between the leaf spring 2 and the pair of crimping portions 43 and 43.

Figure 9:
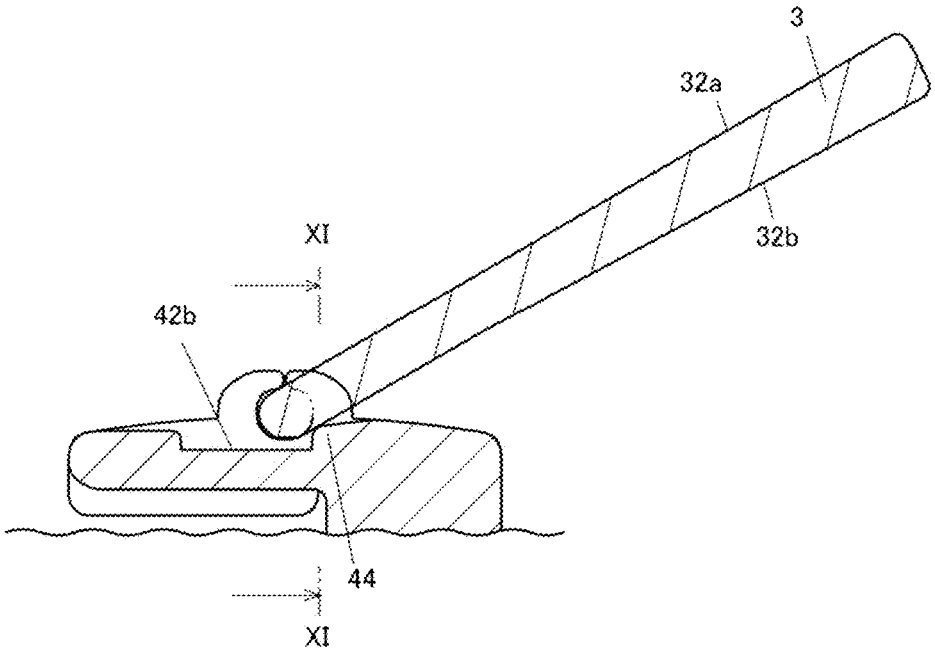
FIG. 9 is a sectional view showing the slider according to the first embodiment, in a state where the pull tab is inclined toward a forward direction.

Further, when the pull tab 3 is turned forward as shown in FIGS. 9 and 11, the pair of stopper portions 44 and 44 and the pull tab main body 32 collide against each other, thereby preventing the pull tab 3 from swinging forward. At this time, because a distal end of the pull tab 3 is located higher than the shaft 31, the pull tab 3 is in a forward-inclined state. Meanwhile, at this time, the pair of stopper portions 44 and 44 are located between the distal end of the pull tab 3 and the shaft 31 in the front and rear direction, more specifically at a portion on the front side of the upper surface of the upper blade main body 41, which is located at the center side, in the front and rear direction, relative to a distal end thereof. At this location, the pair of stopper portions 44 and 44 come in contact with the pull tab main body 32. The pair of stopper portions 44 and 44 is configured so that a scratch of the pull tab main body 32, which is occurred by contact therewith, is occurred close to the shaft 31, for example, as compared with a case where the pair of stopper portions 44 and 44 come in contact with the pull tab main body 32 at the distal end of the front side of the upper surface of the upper blade main body 41, thereby decreasing an influence on an exterior appearance of the pull tab main body 32. Also, the pair of stopper portions 44 and 44 and the corner portions 32*c*1 and 32*c*1 of the right and left side surfaces 32*c* and 32*c* of the pull tab main body 32 are in point-contact with each other. Then, because a scratch occurred by the point contact is occurred on the right and left side surfaces 32*c* and 32*c* of the pull tab main body 32 and also the pair of corner portions 32*c*1 and 32*c*1 thereof, an influence on the exterior appearance of the pull tab main body 32 can be decreased.

Further, each stopper portion 44 is supported by two surfaces, i.e., a side surface of the pull tab attaching post 8 and an upper surface of the lateral recess portion 42*b*, and thus is hardly broken.

Figure 14:
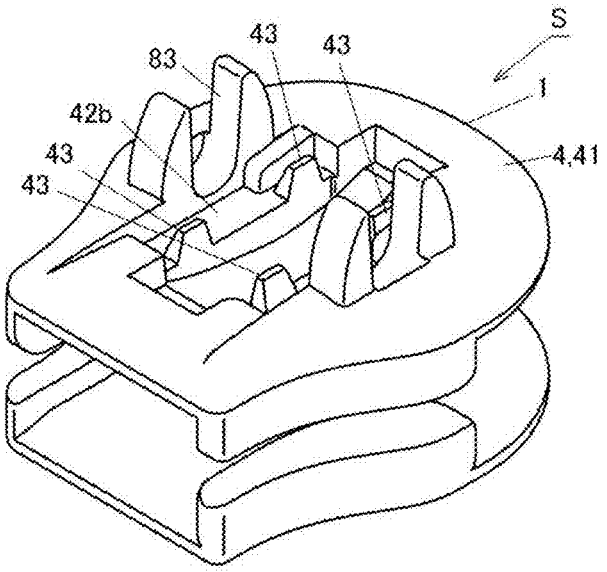
FIG. 14 is a perspective view showing a slider body used in a slider according to a variant of the first embodiment.

Although the slider S according to the first embodiment of the present invention is configured so that one crimping portion 43 is provided on each of right and left sides thereof, the present invention is not limited to this configuration. A slider body 1 used in a variant of the sider S according to the first embodiment is shown in FIG. 14. The slider body 1 is characterized in that four crimping portions 43 are provided to be spaced from each other in the front and rear direction and the right and left direction. More specifically, the slider body 1 is configured so that one crimping portion is provided at each of locations, which are located on the upper surface of the left lateral recess portion 42*b* and are spaced in the front and rear directions from the shaft inserting groove 83, and one crimping portion 43 is also provided at each of corresponding locations on the upper surface of the right lateral recess portion 42*b*. Thus, the leaf spring 2 is crimped by the crimping portions 43 at one location on each of front and rear sides above the right and left sides thereof.

Figure 15:
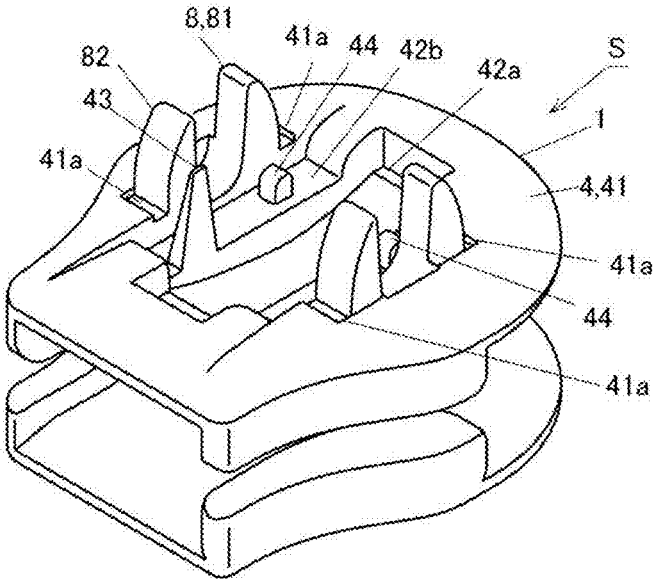
FIG. 15 is a perspective view showing a slider body used in a slider according to a second embodiment of the present invention.

A slider body 1 used in a slider S according to a second embodiment of the present invention is different from the slider body 1 used in the slider S according to the first embodiment in that, as shown in FIG. 15, only one crimping portion 43 is provided, stopper portions 44 are provided at locations spaced laterally from each of pull tab attaching posts 8, and groove portions 41*a* are provided in the front and rear of a lower end portion of each of pull tab attaching posts 8. The details are as follows.

The crimping portion 43 is configured to be located higher than a highest location on the upper surface of the leaf spring 2 and to have a long length to protrude upward in a step before the leaf spring 2 is crimped, and on the other hand, to cover substantially the entire length of a transvers width of the leaf spring 2 in a step after the leaf spring 2 is crimped.

The stopper portions 44 are configured to protrude upward from the upper surfaces of the lateral recess portion 42*b* at locations spaced laterally from the front posts 81 toward the center recess portion 42*a*.

Total number of the groove portions 41*a* formed on the upper blade main body 41 is four. For example, one groove portions 41*a* is formed in the rear of the lower end of the left rear post 82 over the entire width length of the rear post 82. Other three groove portions 41*a* are also formed on the right and left front posts 81 and the right rear post 82 in the same manner. As compared with a case where the there are no groove portions 41*a*, the entire height of the pull attaching posts 8 is increased due to the groove portions 41*a*, and thus when the shaft 31 is attached, the upper end portions of the front posts 81 and the rear posts 82 are easily plastically deformed.

Figure 16:
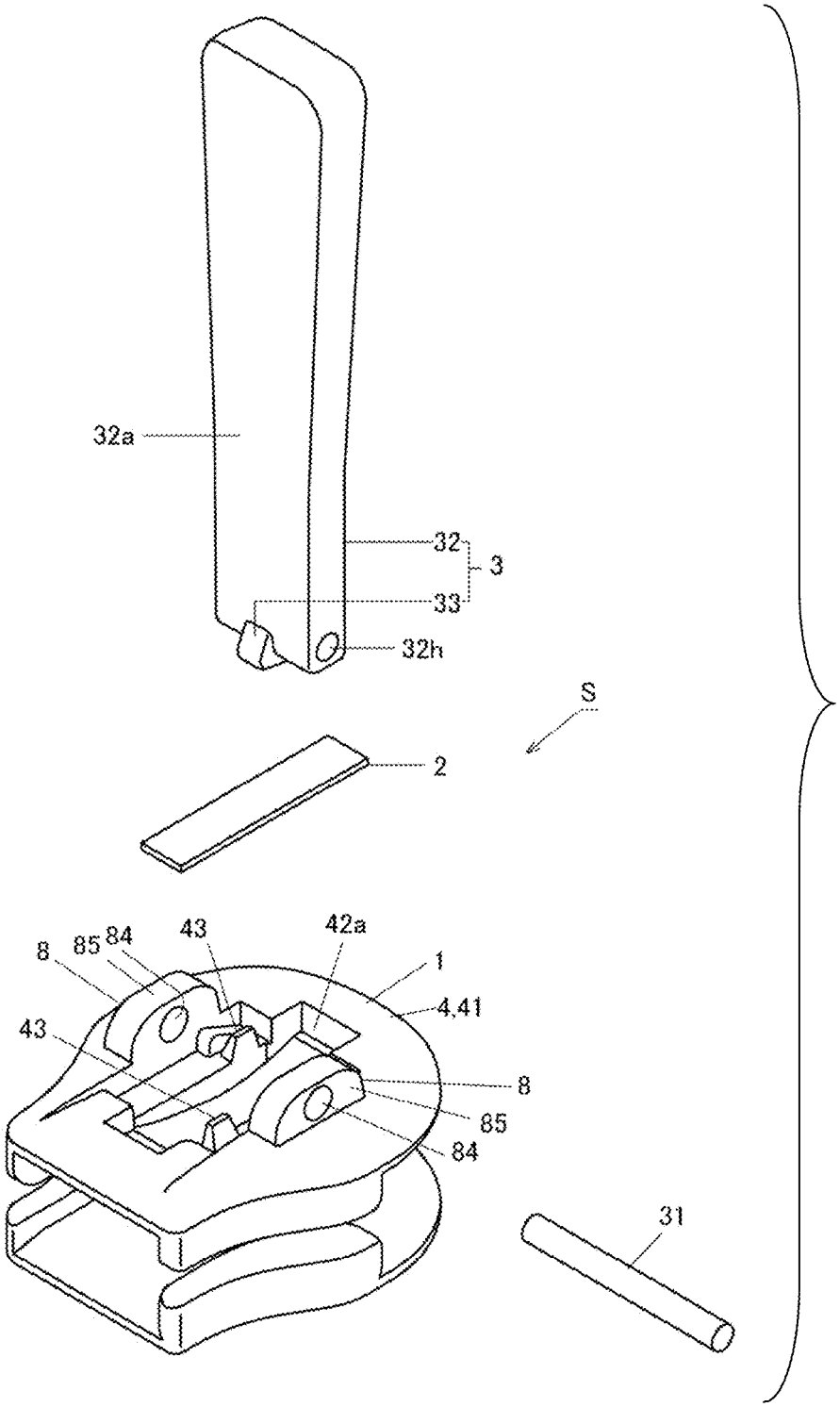
FIG. 16 is a perspective view showing, in an exploded state, a slider according to a third embodiment of the present invention.

A slider S according to a third embodiment of the present invention is different from the slide S according to the first embodiment in that as shown in FIG. 16, a slider body 1 has right and left crimping portions 41 at different locations in the front and rear direction, each of the pull tab attaching posts 8 has a shaft hole 84 extending therethrough only in the right and left direction, and a pull tab 3 is made by a combination of two components. The details are as follows.

The pull tab 3 includes as separate components a unitary body constituted of a pull tab main body 32 and a cam 33, and a shaft 31. The unitary body constituted of the pull tab main body 32 and the cam 33 has a shaft connection hole 32*h* extending in the right and left direction through one lengthwise end portion of the pull tab body 32, and the cam 33 is configured to protrude radially outward from the shaft connection hole 32*h* and thus to protrude from the one end portion of the flat surface portion 32*a* of the pull tab main body 32. The shaft 31 is a cylindrical rod having a dimension longer than a dimension of the shaft connection hole 32*h* in the extending direction and has a radius slightly larger than a radius of the shaft connection hole 32*h*.

One of the right and left crimping portions 43 and 43 (left crimping portion 43 in the figure) is formed at a location located forward relative to the shaft hole 84 in the front and rear direction, and the other (right crimping portion 43 in the figured) is formed at a location located rearward relative to the shaft hole 84.

Each of the pull tab attaching post 8 is a flat plate 85 protruding upward from the upper surface of the upper blade 4 and has the shaft hole 84 formed to extend in the right and left direction through the center, in the front and rear direction and the upward and downward direction, of the flat plate 85.

Upon assembling of the slider S according to the third embodiment, the leaf spring 2 is mounted on the center recess portion 42*a* of the slider body 1, and then one lengthwise end portion of the pull tab main body 32, on which the cam 33 is located, is arranged between the pair of pull tab attaching posts 8 and 8 and the shaft 31 passes through the shaft holes 84 and 84 of the pair of pull tab attaching posts 8 and 8 and the shaft connection hole 32*h* of the pull tab main body 32. Meanwhile, the shaft 31 is press-fitted into the shaft connection hole 32*h* of the pull tab main body 32, so that the pull tab main body 32 and the shaft 31 are integrated with each other.

The slider of the present invention is not limited to the forgoing embodiments, but may be appropriately modified without departing the spirit and scope of the invention.

What is claimed is:

1. A slider for a slide fastener, comprising:

a slider body comprising an element passage extending therethrough in a front and rear direction of the slider;

an elastic body attached on an upper surface of the slider body and elongated in the front and rear direction; and a pull tab supported on the slider body to be swingable in the front and rear direction above the elastic body, wherein the pull tab comprises a shaft extending in a right and left direction and rotatably supported on the slider body, a pull tab main body extending radially outward from the shaft, and a cam protruding radially outward from the shaft, wherein the cam is configured to elastically deform the elastic body when the pull tab is laid down toward one of front and rear sides of the upper surface of the slider body, wherein the slider body comprises, on an upper portion thereof, an upper blade covering the element passage from above and a pair of pull tab attaching posts protruding from right and left sides of an upper surface of the upper blade, wherein the upper blade comprises a recess portion and a crimping portion for crimping the elastic body, between the pair of pull tab attaching posts on the upper surface thereof, wherein the recess portion comprises a pair of lateral recess portions located on right and left sides thereof, and a center recess portion located between the pair of lateral recess portions and configured to receive the elastic body therein, wherein the crimping portion is configured to protrude from at least one of the pair of lateral recess portions at a protruding location located at a center side relative to both front and rear ends of the center recess portion, and wherein the pair of lateral recess portions are located between the center recess portion and the pair of pull tab attaching posts, respectively.

2. The slider for the slide fastener according to claim 1, wherein the center recess portion comprises a pair of front and rear mount surface portions for mounting front and rear ends of the elastic body thereon, and a bottom surface portion arranged between the pair of mount surface portions and located lower than the mount surface portions, and wherein the crimping portion is configured to cover the bottom surface portion from above.

3. The slider for the slide fastener according to claim 1, wherein the pair of lateral recess portions have upper surfaces located higher than an upper surface of the center recess portion.

4. The slider for the slide fastener according to claim 1, wherein the upper blade comprises a horizontal pedestal portion arranged on the upper surface thereof on one side in the front and rear direction from the recess portion and located higher than an upper surface of the recess portion, and wherein the pull tab main body has a flat surface portion to come in face-contact with the pedestal portion in a laid-down state.

5. The slider for the slide fastener according to claim 4, wherein an upper surface of the pedestal portion is formed to be located higher than an upper end of the crimping portion.

6. The slider for the slide fastener according to claim 1, wherein the upper blade comprises a pair of stopper portions arranged on the other of the front and rear sides of the upper surface of the slider body and configured to hold the pull tab in an inclined state, and wherein the pair of stopper portions are formed at locations at the center side, in the front and rear direction, relative to a distal end of the other of the front and rear sides of the upper surface of the upper blade.

7. The slider for the slide fastener according to claim 6, wherein the pair of stopper portions are configured to protrude from opposing surfaces, which correspond to the pair of lateral recess portions, of the pull tab attaching posts toward the center recess portion.

* * * * *